United States Patent [19]

Jöns et al.

[11] 4,124,335

[45] Nov. 7, 1978

[54] INTERENGAGING GEAR MACHINE WITH COMPENSATING FORCE ON BEARING MEMBERS

[75] Inventors: Claus Jöns, Korntal; Erich Schönherr, Stuttgart; Günter Wolff, Schwieberdingen, all of Fed. Rep. of Germany

[73] Assignee: Robert Bosch GmbH, Stuttgart, Fed. Rep. of Germany

[21] Appl. No.: 775,587

[22] Filed: Mar. 8, 1977

[30] Foreign Application Priority Data

Mar. 15, 1976 [DE] Fed. Rep. of Germany ..... 2610827

[51] Int. Cl.[2] ..... F01C 19/08; F01C 21/02

[52] U.S. Cl. ..... 418/73; 418/132

[58] Field of Search ..... 418/71, 73, 131, 132

[56] References Cited

U.S. PATENT DOCUMENTS

| | | | |
|---|---|---|---|
| 1,673,259 | 6/1928 | Meston et al. | 418/131 |
| 3,961,872 | 6/1976 | Muller et al. | 418/132 |

FOREIGN PATENT DOCUMENTS

| | | | |
|---|---|---|---|
| 2,261,854 | 7/1974 | Fed. Rep. of Germany | 418/73 |
| 782,701 | 9/1957 | United Kingdom | 418/73 |

*Primary Examiner*—John J. Vrablik

*Attorney, Agent, or Firm*—Michael J. Striker

[57] ABSTRACT

A pair of mating gears are mounted for rotation about respective axes in a gear-type fluid displacing pump or motor. Each gear has a pair of shaft portions at opposite axial ends of the respective gear, and bearing members surround respective ones of the shaft portions for journalling the gears. Each bearing member of one of the gears is juxtaposed with a respective bearing member of the other of said gears and, during rotation of the gears, the juxtaposed bearing members are subjected to forces which urge the bearing members to move relative to each other, particularly in direction towards each other. An arrangement is provided to counteract such forces and to oppose such relative movement of the juxtaposed bearing members.

7 Claims, 5 Drawing Figures

Fig. 3
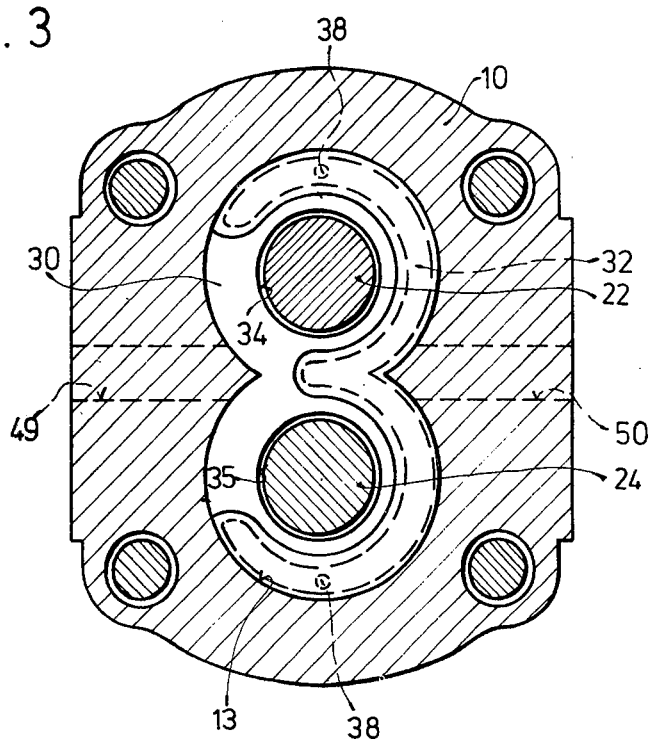
Fig. 4
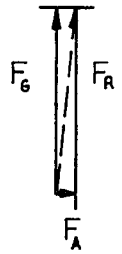
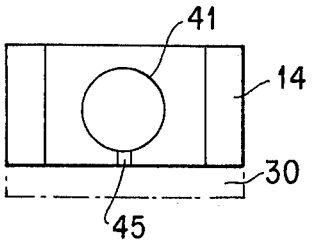
Fig. 5

INTERENGAGING GEAR MACHINE WITH COMPENSATING FORCE ON BEARING MEMBERS

BACKGROUND OF THE INVENTION

The present invention generally relates to a gear-type fluid displacing machine and, more particularly, to external gear-type hydraulic pumps or motors and, still more particularly, to improvements in the operation of such hydraulic machines.

During the operation of presently known gear-type pumps, the finite number of component parts of such machines causes non-uniform delivery of fluid to be pumped to a user. The torque characteristic of such machines also varies widely between maximum and minimum values. Such non-uniform operation is highly unsatisfactory for most commercial applications.

Moreover, during operation of such gear-type machines, the rotating gears are subjected to forces which urge the gears to move relative to each other due to an unequal distribution of pressure which exists in the region about the gears. Such forces have a force component which urges the gears, and concomitantly the bearing members which journal the gears, towards each other. Moreover, such forces have a force component which urges the gears against the inner circumferential wall of the housing chamber in which the gears are mounted.

Such forces are highly undesirable because they generate fluctuations in the rate and quantity of the fluid to be displaced in the machine, thereby decreasing the efficiency of the operation of the machine. Such fluctuations also generate chatter and prevent quiet, smooth-running operation.

SUMMARY OF THE INVENTION

Accordingly, it is the general object of the present invention to overcome the disadvantages of the prior art.

Another object of the present invention is to improve the efficiency of operation of a gear-type machine.

Still another object of the present invention is to counteract any forces which tend to move the gears and their associated bearing members relative to each other.

Yet another object of the present invention is to provide a quiet, smooth-running fluid displacing machine.

In keeping with these objects and others which will become apparent hereinafter, one feature of the invention resides, briefly stated, in a combination in a gear-type fluid displacing machine, particularly a pump or a motor, which comprises a pair of mating gears each having a pair of shaft portions at opposite axial ends of the respective gear. The gears are mounted in the machine for rotation about respective axes. A pair of bearing members journal each gear, and each bearing member surrounds one of the shaft portions. Moreover, each bearing member of one of the gears is juxtaposed with a respective bearing member of the other of said gears. During rotation of the gears, the bearing members are subjected to forces which urge the bearing members to move relative to one another along a direction such that the distance between the axes of rotation of the gears is changed. In accordance with the invention, counteracting means are operative for opposing such forces and such relative movement of the juxtaposed bearing members. If the forces urge the juxtaposed bearing members to move in direction generally towards each other, then the counteracting means is operative for preventing such relative movement of the juxtaposed bearing members towards each other.

In a preferred embodiment, the juxtaposed bearing members bound a gap with each other, and the counteracting means which is in communication with a high-pressure zone of the machine conveys this high pressure to this gap. A compensating force is thereby generated in the gap and acts to oppose the undesirable forces which act on the gears and on the bearing members.

The invention thus overcomes the prior art problem of having the bearing members strike each other with relatively great noise at relatively fast speeds and with relatively large force magnitudes. The rather high contact pressure between bearing members of prior art constructions is likewise substantially reduced. Gears mounted in machines of the present invention will no longer move through or oscillate within large distances, i.e. gear play is substantially reduced towards zero with the machines of the present invention.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 3 is a side view in vertical section of the fluid-displacing machine of FIG. 1, taken along line III—III with the sealing elements removed for the sake of clarity;

FIG. 4 is a force diagram showing the force components of the resultant force produced in accordance with the present invention; and FIG. 5 is a view showing a recess provided in one of the bearing members of the fluid-displacing machine.

DESCRIPTION OF THE PREFERRED EMBODIMENTS

Figure 1:
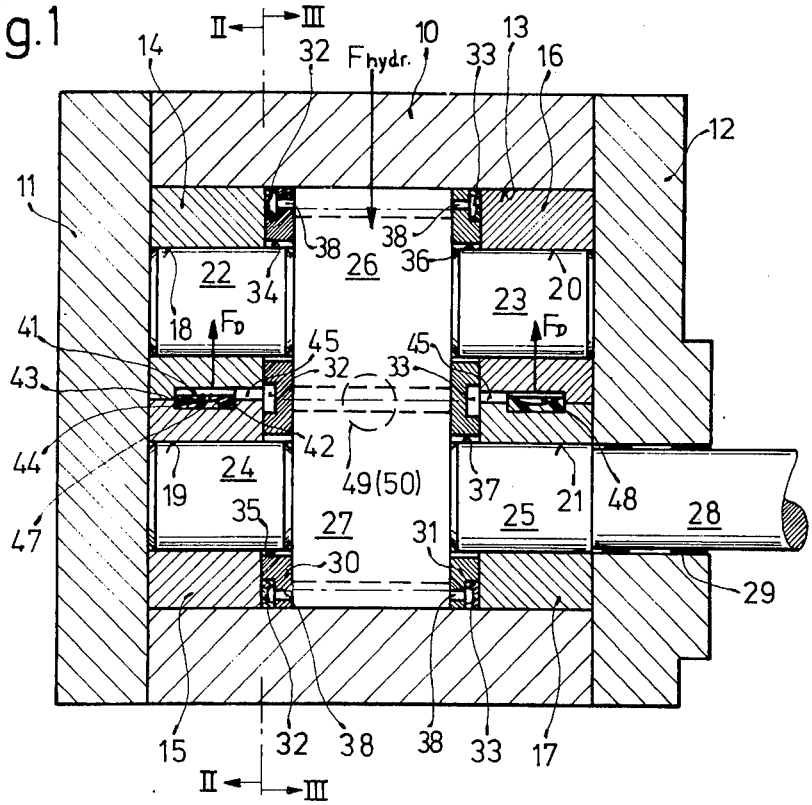
FIG. 1 is a longitudinal section through a gear-type fluid displacing machine in accordance with the present invention.

The gear-type fluid displacing machine of FIG. 1 may be used either as a pump or as a motor. The machine comprises a housing having a main or central section 10 and two outer side sections or covers 11 and 12 which are bolted to the main section 10, as shown in FIG. 3. The covers 11 and 12 overlie and seal opposite ends of a chamber 13 which has a cross-sectional configuration fashioned after the number "eight." The "eight"-shaped chamber 13, as shown in FIG. 3, comprises two partially overlapping cylindrical bores which are machined into the main section 10.

A pair of mating gears 26 and 27 are respectively received in the bores of chamber 13, and the gears are operative for generating a high-pressure zone or area in the machine as they rotate. Gear 26 has trunnions or stub shaft portions 22, 23 at its opposite axial ends; and gear 27 has analogous stub shaft portions 24, 25 at its opposite axial ends. Each bore of the chamber 13 receives a pair of coaxial annular bearing members 14, 16 or 15, 17. Bearing members 14, 16 respectively surround shaft portions 22, 23, thereby journalling gear 26. Bearing members 15, 17 respectively surround shaft portions 24 and 25, thereby journalling gear 27. Bearing members 14–17 are formed with interior bores 18–21 which respectively receive stub shaft portions 22, 24, 23 and 25.

One of the shaft portions, e.g. the shaft portion 25 of gear 27, has an extension 28 which passes through an opening 29 formed in cover 12. The free end of this extension 28 can be coupled to a prime mover, not shown.

Sealing plate 30 is located between the axial ends of gears 26, 27 which face bearing members 14, 15 and the axial ends of the latter. Similarly, sealing plate 31 is located intermediate the opposite axial ends of gears 26, 27, which face bearing members 16, 17 and the axial ends of the latter. Sealing plates 30, 31 are formed with bores 34–37 which respectively surround shaft portions 22, 24, 23 and 25 with clearance. Sealing plates 30, 31 facilitate fluid leakage reduction within the machine since they are pressed by hydraulic forces in sealing engagement with the respective axial ends of the bearing members 14–17 and the axial ends of the gears 26, 27.

Sealing plates 30, 31 are respectively formed with channels 32, 33 in which sealing elements are accomodated. Each channel 32, 33 has a configuration fashioned after the numeral "three," as shown in FIG. 3. Bores 38 establish communication between the channels 32, 33 and a high-pressure zone established by the rotating gears during operation of the fluid displacing machine.

The fluid displacing machine has an input port 50 and an output port 49. When used as a pump, input port 50 is at low pressure and output port 49 is at high pressure. Conversely, when used as a motor, input port 50 is at high pressure and output port 49 is at low pressure.

During rotation of gears 26, 27 an unequal distribution of pressure exists about the periphery of the gears which subjects the gears to a hydraulic force $F_{hydr}$ having a force component which urges the gears towards each other. Concomitantly, the individual members of the juxtaposed pairs of bearing members 14, 15 and 16, 17 are urged towards each other. As noted above, this relative movement or play is highly undesirable because the gears and bearing members cannot operate efficiently and quietly as a result of such undesirable play.

Figure 2:
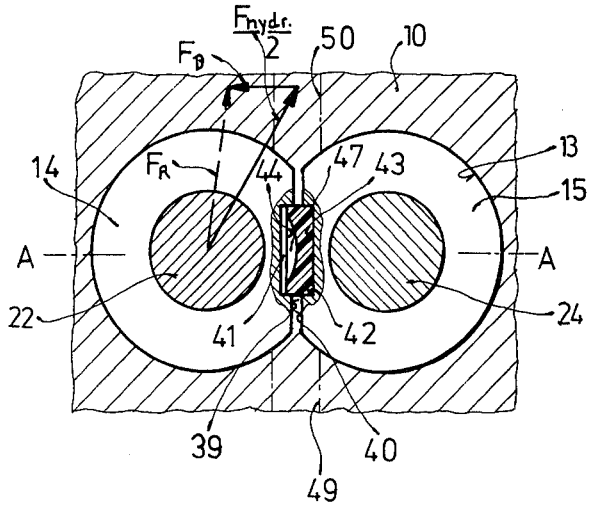
FIG. 2 is a side view in partial vertical section taken along line II—II of FIG. 1 with a force diagram illustrating the lines of action of various forces in the fluid displacing machine.

FIG. 2 shows a proposed way of counteracting such relative movement. A cutout or cylindrical recess 41 is formed at side surface 39 of bearing member 14. Another similar cutout or cylindrical recess 42 faces cutout 41 and is formed at side surface 40 of bearing member 15. The line of symmetry of the cylindrical cutouts 40, 41 extends generally normally of the axes of rotation of gears 26, 27, i.e. the line of symmetry extends in direction of line A—A.

An insert member 43, preferably of elastic resilient material, is mounted in recess 42 so that the insert member 43 is flush with the closed end of recess 42. The insert member 43 extends into and is received in recess 41. The upper surface 44 of insert member 43 is arcuate and bounds a space or gap 47 with the closed end of recess 41.

In accordance with the invention, the high pressure generated by the gears 26, 27 during operation of the machine is communicated via bores 38 to channel 32. A connecting bore 45 connects the channel 32 with the gap 47. Thus, a compensating force is generated in gap 47 which has a force component $F_D$ which opposes the relative movement of the juxtaposed bearing member pair 14, 15.

An analogous situation exists for the other juxtaposed bearing member pair 16, 17. In this case, a compensating force component $F_D$ is similarly generated in gap 48 which is bounded by bearing members 16 and 17.

Now, with particular reference to the force vector diagram of FIG. 2, vector $F_{hydr}/2$ identifies a proportionate fraction of the entire hydraulic force $F_{hydr}$ which acts to urge bearing member 14 along a direction in which the bearing member 14 is not only urged against the inner circumferential wall of chamber 13, but also is urged towards the other bearing member 15. The generated compensating force has a force component $F_D$ which, when vectorially added to vector $F_{hydr}/2$, produces a resultant force $F_R$. Resultant force $F_R$ is shown in dashed lines in FIG. 2, and its constituent parts are identified in FIG. 4 by force component $F_G$ and force component $F_A$.

It will be noted that the original hydraulic force vector $F_{hydr}/2$ has been effectively modified to assume the magnitude and direction of the resultant force $F_R$. This means that the force which tends to move bearing members 14 and 15 towards each other has been correspondingly reduced. This modification of the forces acting on gear 14 results therefore in the desired greatly reduced play in the operation of the machine.

The magnitude of vector $F_A$ is very small and, ideally, this magnitude is zero. The magnitude of $F_A$ is of course dependent upon the magnitude of the force component $F_D$ which in turn depends upon the size of the gaps 47, 48. For high volumetric discharge pumps the gaps between the bearing members may not be adequate to produce a sufficiently strong compensating force. Therefore, additional gaps may be arranged at the periphery of the bearing members, for example at the low pressure side of the machine.

The additional forces generated in such gaps are operative for properly dimensioning the resultant force so that the magnitude of the force components thereof, i.e. $F_A$ and/or $F_G$ may be selected and adjusted as desired. The invention thereby contemplates providing at least one and preferably a plurality of high-pressure areas at any desired location about the periphery of the individual bearing members. These high-pressure areas are operative for preventing undesired movement, such as movement of juxtaposed bearing members towards each other and/or movement of the bearing members against a circumferential wall of the chamber.

It will be understood that each of the elements described above, or two or more together, may also find a useful application in other types of constructions differing from the types described above.

While the invention has been illustrated and described as embodied in a gear-type fluid displacing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a gear-type fluid displacing machine, a combination comprising a pair of mating gears each having a pair of shaft portions at opposite axial ends of the respective gears; means for mounting said gears in the machine for rotation about respective axes, including a pair of bearing members for journalling each gear, each bearing member surrounding one of said shaft portions, and each bearing member of one of said gears being juxtaposed with a respective bearing member of the other of said gears and being subjected to forces which urge each bearing member of said one gear to move in direction generally toward the respective juxtaposed bearing member of said other gear during rotation of said gears; and counteracting means for opposing such forces and such relative movement of said juxtaposed bearing members toward each other, said counteracting means including a first recess provided in an outer surface of each bearing member of said one gear and a second recess provided in an outer surface of the respective juxtaposed bearing member and facing toward said first recess to define therewith between said bearing members a hole, means operatively associated with said hole to seal said hole, said hole being blind and provided with communicating means which communicates said blind hole solely with a source of a pressurized fluid medium so that said fluid medium flows from said source into said blind hole and accumulates in the latter without being discharged therefrom whereby a substantial compensating force is generated in said blind hole and urges said bearing members outwardly away from each other.

2. A combination as defined in claim 1, wherein said mating gears are operative for generating a high-pressure zone in the machine forming said source, and wherein said communicating means includes passage means intermediate said recesses and said high-pressure zone for communicating the latter with the former so that said pressurizable fluid medium flows to and enters said recesses for thereby generating said compensating force in said blind hole.

3. A combination as defined in claim 2, wherein said juxtaposed bearing members have axial ends which face said gears; and further comprising a pair of sealing plates each located intermediate said axial ends of said juxtaposed bearing members and said axial ends of the respective gear, each sealing plate having a channel in communication with said high-pressure zone.

4. A combination as defined in claim 3, wherein said passage means includes connecting passages intermediate said channels and said recesses.

5. In a gear-type fluid displacing machine, a combination comprising a pair of mating gears each having a pair of shaft portions at opposite axial ends of the respective gear; means for mounting said gears in the machine for rotation about respective axes, including a pair of bearing members for journalling each gear, each bearing member surrounding one of said shaft portions, and each bearing member of one of said gears being juxtaposed with a respective bearing member of the other of said gears and being subjected to forces which urge each bearing member of said one gear to move in direction generally toward the respectively juxtaposed bearing member of said other gear during rotation of said gears; counteracting means for opposing such forces and such relative movement of said juxtaposed bearing members toward each other, said counteracting means including a first recess provided in an outer surface of each bearing member of said one gear and a second recess provided in an outer surface of the respective juxtaposed bearing member and facing toward said first recess to define therewith between said bearing members a blind hole communicating with a source of pressure so as to generate in said blind hole a compensating force which urges said bearing members outwardly away from each other; and an insert member mounted in both of said recesses of said juxtaposed bearing members to provide a seal for said blind hole.

6. A combination as defined in claim 5, wherein said insert member partially fills both of said recesses so as to leave an unfilled gap communicating with said source of pressure.

7. A combination as defined in claim 5, wherein each of said recesses has a cylindrical configuration and an axis of symmetry which extends substantially normally of said axes of rotation.

* * * * *